US007210594B2

(12) United States Patent
Schütz

(10) Patent No.: US 7,210,594 B2
(45) Date of Patent: May 1, 2007

(54) TRANSPORT AND STORAGE CONTAINER FOR LIQUIDS

(75) Inventor: Udo Schütz, Selters/Westerwald (DE)

(73) Assignee: Protechna S.A., Fribourg (CH)

( * ) Notice: Subject to any disclaimer, the term of this patent is extended or adjusted under 35 U.S.C. 154(b) by 580 days.

(21) Appl. No.: 10/809,045

(22) Filed: Mar. 25, 2004

(65) Prior Publication Data

US 2004/0218336 A1 Nov. 4, 2004

(30) Foreign Application Priority Data

Mar. 26, 2003 (DE) ..... 103 13 481

(51) Int. Cl.
*B65D 25/14* (2006.01)

(52) U.S. Cl. ..... 220/1.6

(58) Field of Classification Search ..... None
See application file for complete search history.

(56) References Cited

U.S. PATENT DOCUMENTS 5,971,185 A * 10/1999 Schutz ..... 220/1.6
5,979,685 A * 11/1999 Schutz ..... 220/1.6
6,050,437 A * 4/2000 Schutz ..... 220/4.12
6,156,969 A * 12/2000 Schutz ..... 174/17 LF
2004/0069781 A1* 4/2004 Schutz ..... 220/9.1
2004/0218336 A1* 11/2004 Schutz ..... 361/215
2005/0092639 A1* 5/2005 Schutz ..... 206/386

* cited by examiner

*Primary Examiner*—Stephen J. Castellano
(74) *Attorney, Agent, or Firm*—Friedrich Kueffner

(57) ABSTRACT

A transport and storage container for liquids has a support frame of electrically conducting metal or plastic material. An inner plastic container is positioned on the support frame and has an electrically conducting exterior layer for electrically grounding the outer surface of the inner container. The inner container has an outlet socket with an electrically conducting outer layer arranged near the bottom. The outlet socket is formed as a unitary part of the inner container and has an outer cylindrical end drawn inwardly to form an inner ring with an annular electrically conducting inner layer that is in contact with liquid in the inner container for electrically grounding the interior of the inner container. The electrically conducting inner and outer layers of the outlet socket and the external container layer form a homogenous electrically conducting layer providing inner and outer electric grounding.

5 Claims, 2 Drawing Sheets

TRANSPORT AND STORAGE CONTAINER FOR LIQUIDS

BACKGROUND OF THE INVENTION

1. Field of the Invention

The invention relates to a transport and storage container for liquids, comprising: a pallet-shaped support frame of electrically conducting metal or of an electrically conducting plastic material; an exchangeable single-layer or multi-layer inner container of plastic material positioned on the support frame and having an electrically conducting outer layer for electrically grounding the outer surface of the container, wherein the inner container is configured as a parallelepipedal or cubic container having four sidewalls, a bottom and a top wall, a closable filling socket at the top wall, and an outlet socket that is arranged in one of the sidewalls in the area of the bottom and is designed to receive a tap fixture; and an outer jacket that surrounds the inner container and is made of metallic bars forming a wire mesh or of sheet metal.

2. Description of the Related Art

A transport and storage container for liquids of this kind is disclosed in German patent application DE 101 24 681 A1. It is provided with electric grounding of the inner plastic container, wherein the electric grounding comprises an electrically conducting area that extends as a unitary part from the inner side to the outer side of the inner container. The inner plastic container has an electrically conducting external layer that serves, together with the outer jacket comprised of metallic bars forming a mesh or sheet metal and the metallic support frame, as an outer electric grounding in order to prevent electrostatic charging of the surface of the inner plastic container caused by friction during transport and handling of the container.

For electrically grounding the interior (filling space) of the inner plastic container, the tap fixture of the container is used that is embodied as a slide valve and is fastened by means of a spigot nut on the outlet socket of the inner container; its inlet projects into the interior. The slide valve housing has an inner paint coat and an outer paint coat comprising electrically conducting polymers. Electric charges that occur by liquid friction on the inner surface of the container and within the liquid itself during filling and emptying of the inner container and during stirring of liquid within the inner container, for example, for mixing purposes, are dissipated via the slide valve housing, the spigot nut that is manufactured of electrically conducting material, the external layer of the inner container, the outer jacket of the transport and storage container, and the pallet-shaped support frame.

The permanent antistatic configuration of the tap fixture of the inner container that is required for the inner electric grounding of the inner container of the transport and storage container causes the manufacturing costs of the container to become more expensive.

German patent application DE 197 31 518 A1 discloses a transport and storage container for liquids that is electrically grounded by a mesh cover that is placed onto the inner plastic container or an electrically conducting net or mesh applied to the inner container. As a result of this external grounding, only those electrical charges present on the container surface are dissipated. Moreover, the electrical grounding of the liquid container by means of a mesh cover, a net or a mesh is technically complex and results in a corresponding increase of the manufacturing costs.

In a transport and storage container for liquids disclosed in German patent application DE 198 15 082 A1, the tap fixture connected to the outlet socket of the inner container is provided with a grounding element that is formed as a curved sheet metal or plate made of metal that extends across a partial area of the inner bore of the tap fixture and is connected by means of a fastening screw and a ground wire to the support frame of the container. By means of the internal grounding only the electrical charges that are produced by liquid friction within the liquid are dissipated. Moreover, in this liquid container there is the risk that during transport and storage of aggressive liquids the grounding element will become damaged by liquid to such an extent that the electrical grounding action is no longer functional.

SUMMARY OF THE INVENTION

It is an object of the present invention to further develop the transport and storage container for liquids of the aforementioned kind with regard to a safe and comprehensive grounding of the inner plastic container and with regard to an inexpensive manufacture.

In accordance with the present invention, this is achieved in that the outer cylindrical end of the outlet socket of the inner container, provided with an outer thread and formed as a unitary part of the inner container by blow-molding and having an electrically conducting outer layer, is drawn in to form an inner ring with an annular electrically conducting inner layer, wherein the inner layer is in contact with the liquid filling material for electrical grounding of the interior of the inner container, and wherein the inner and the outer layers of the outlet socket and the external layer of the inner container body form a homogenous, electrically conducting layer for inner and outer electrical grounding of the inner plastic container.

The invention resides in that in a transport and storage container for liquids, comprising a multi-layer inner plastic container with an electrically conducting external layer, an outer mesh jacket of metal or an outer sheet metal jacket, as well as a pallet-shaped support frame made of metal or an electrically conducting plastic material, the outer cylindrical end of the outlet socket, provided with an outer thread and formed by blow-molding as a unitary part of the inner plastic container, is drawn in toward the interior of the container to form an inner ring inside the outlet socket having an annular, electrically conducting inner layer that is in contact with the liquid filling material and, in this way, provides inner grounding of the interior of inner container so that the electrical charges, occurring during transport by mutual friction of inner container and outer jacket on the container surface and generated within the liquid because of liquid friction when filling and emptying the transport and storage container and when stirring liquids in the container, for example, for mixing purposes, are dissipated into the ground by way of the electrically conducting inner and outer layers of the outlet socket of the inner container, the outer layer of the inner container, the outer jacket, and the support frame. Because of the electrically conducting configuration of the outlet socket of the inner container, in whose flow opening the largest liquid friction within the container occurs when removing liquid from the container as a result of the flow speed of the liquid, an electrical charging of the liquid and of the container is prevented in a simple and effective way. The electrical grounding of the container surface of the inner plastic container and of the liquids to be transported or stored therein enables also the use of the transport and storage container as a hazardous material container for flammable liquids and emulsions such as solvents, paints, and varnishes having a flash point of <61° C. as well as the use of the containers in working areas where an explosive atmosphere can be formed by gases, vapors, and mists.

DESCRIPTION OF THE PREFERRED EMBODIMENTS

Figure 1:
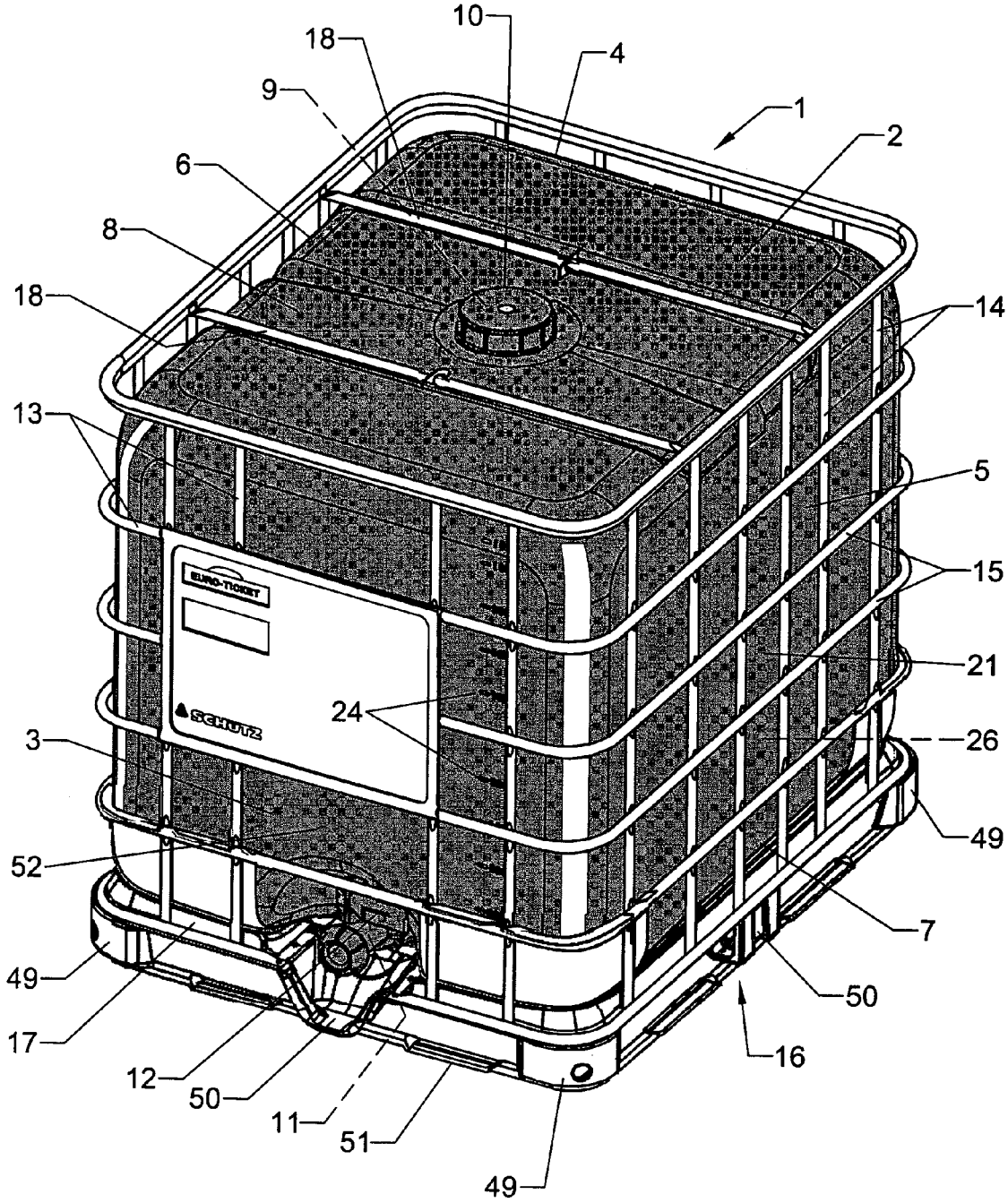
FIG. 1 is a perspective illustration of a transport and storage container.
Figures 2, 3:
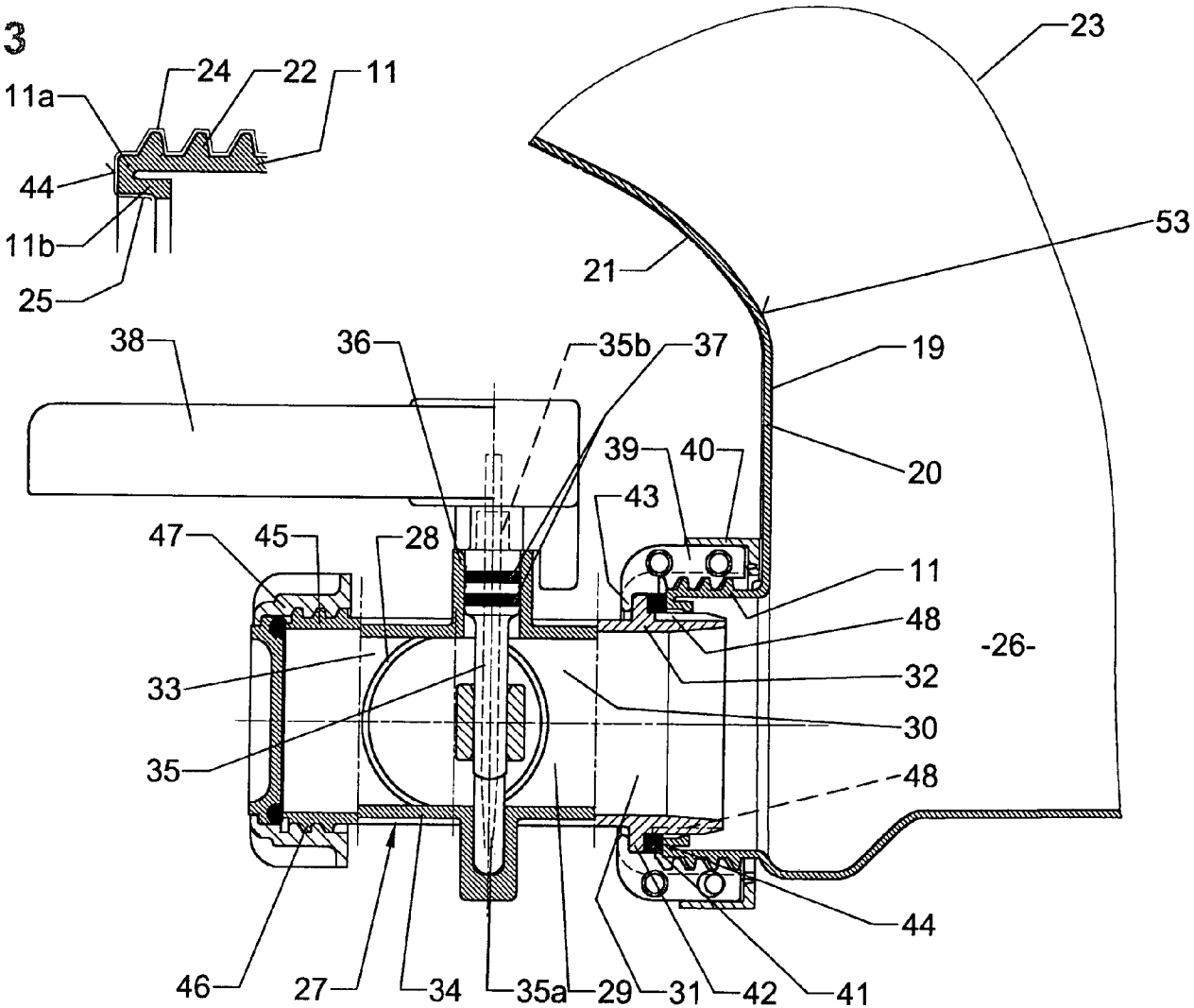
FIG. 2 is a vertical section of the outlet area of the container with a tap fixture screwed onto the outlet socket of the inner container.
FIG. 3 is a partial longitudinal section of the outlet socket of the inner container.

The transport and storage container 1 that can be used as a disposable container or reusable container for liquids has the following main components: an exchangeable, parallelepipedal inner container 2 made of polyethylene and comprising a front wall 3, a back wall 4, and two sidewalls 5, 6 as well as a bottom 7, formed as a drainage bottom, a top wall 8 with a filling socket 9 that can be closed by a screw cap 10, and an outlet socket 11 arranged in the front wall 3 in the area of the bottom 7 for receiving a tap fixture; the tap fixture can be embodied as a butterfly valve 12 or ball valve; an outer jacket 13 of crossing vertical and horizontal bars 14, 15 of metal forming a wire mesh, a pallet-shaped support frame 16 comprising a flat bottom tub 17 of sheet metal on which the inner container 2 is positioned, as well as two top bars 18 of metal for protecting the inner container 2.

Front wall 3, back wall 4, sidewalls 5, 6 as well as bottom 7 and top wall 8 of the inner plastic container 2, manufactured of high-density polyethylene by extrusion blow-molding, are comprised of an inner container layer 19, a central container layer 20, as well as an electrically conducting external container layer 21 comprising a conducting carbon black fraction. The thickness of the central container layer 20 is 1 to 2 millimeters., preferably 1.2 millimeters, and the thickness of the inner and external layers 19, 21 is 0.1 to 0.5 millimeters, preferably 0.2 millimeters.

For manufacturing the central container layer, a recycled granular material or ground material comprised of pure polyethylene and/or polyethylene comprising a conducting carbon black fraction is used, and the starting material for the inner and external container layers 19, 21 is in the form of new polyethylene granules.

The outlet socket 11 provided with the outer thread 22 of the inner container 2 is blow-molded as a unitary part of the inner container body 23 and the outer cylindrical end 11*a* of the outlet socket 11 comprising an electrically conducting outer layer 24 is drawn in to form an inner ring 11*b* with an annular, electrically conducting inner layer 25 that contacts the material filled into the interior 26 of the inner container 2 for electrically grounding the interior. The inner layer 25 and the outer layer 24 of the outlet socket 11 and the outer layer 21 of the inner container body 23 form a homogenous electrically conducting layer.

The tap housing 27 of the butterfly valve 12 is produced of high-density polyethylene and receives a valve flap 28 for opening and closing the central flow opening 29 of the housing chamber 30 that is in communication with the intake channel 31 of the intake 32 and the outlet channel 33 of the outlet 34 of the tap housing 27. The valve flap 28 is eccentrically fastened on a rotary shaft 35; the rotary shaft 35 has a first end 35*a* rotatably supported in the tap housing 27 and a second end 35*b* projecting from the housing 27 to the exterior through a bearing 36. The rotary shaft 35 is sealed relative to the exterior by means of sealing rings 37 in the bearing 36. On the end 35*b* of the rotary shaft 35 projecting from the housing 27, a handle 38 is provided for opening and closing the butterfly valve 12.

The butterfly valve 12 is fastened by means of a spigot nut 39, comprised of metal or plastic material and provided with a proof of authenticity (temper evidence) 40, on the outlet socket 11 of the inner plastic container 2 of the transport and storage container 1.

When screwing the spigot nut 39, that is arranged captively on the intake 32 of the tap housing 27, onto the outlet socket 11 of the inner container 2 of the transport and storage container 1, a sealing ring 41 that is seated on the intake 32 of the tap housing 27 is clamped between a collar 42 of the intake 32, that is engaged by the spigot nut 39 by means of an annular projection 43, and the end face 44 of the outlet socket 11 of the inner container 2, and, in this way, a liquid-tight connection between the butterfly valve 12 and the inner container 2 is achieved.

The outer end 45 of the outlet 34 of the tap housing 27 has an outer thread 46 for screwing a protective cap 47 thereon during transport and storage of the container; a drainage hose can also be screwed onto the thread.

The high-density polyethylene imparts to the tap housing 27 a limited elasticity that enables a tight closing position of the valve flap 28 of the butterfly valve 12 by elastic widening of the seat of the tap housing 27 in the closed position of the valve flap 28.

The liquid filled into the interior 26 of the inner container 2 is in contact with the electrically conducting inner layer 25 of the inner ring 11*b* of the outlet socket 11 of the inner container 2 by means of longitudinal grooves 48 on the outer circumference of the intake 32 of the butterfly valve 12 inserted into the outlet-socket 11 of the inner container 2.

The bottom tub 17 of the support frame 16 of the transport and storage container 1 is positioned at a certain ground clearance on corner legs 49 and center legs 50 and a bottom frame 51 or rails so that the bottom side of the bottom tub 17 can be accessed from four sides of the container by gripping arms of a transport device, for example, fork arms of a forklift, for transporting the container. The legs 45, 50 and the bottom frame 51 or the rails are made of electrically conducting metal or an electrically conducting plastic material, for example, polyethylene, containing a conducting carbon black fraction so that the inner plastic container 2 of the transport and storage container 1 is provided with external electric grounding of the container surface 52 and inner electric grounding of the interior 26 via the electrically conducting external layer 21 of the inner container 2 and the electrically conducting inner and outer layers 25, 24 of the outlet socket 11 as well as the electrically conducting external layer 21 of the inner container 2 and the outer jacket 13 and the support frame. In this way, electrical charges that occur on the container surface 52 and the inner wall 53 of the inner container 2 as well as within the liquid filled into the interior 26 of the inner container are dissipated into the ground.

While specific embodiments of the invention have been shown and described in detail to illustrate the inventive principles, it will be understood that the invention may be embodied otherwise without departing from such principles.

What is claimed is:

1. A transport and storage container for liquids, comprising:

a pallet-shaped support frame of electrically conducting metal or an electrically conducting plastic material;

an exchangeable single-layer or multi-layer inner container of plastic material, wherein the inner container is positioned on the support frame and has an electrically conducting exterior-container layer for electric grounding an outer container surface of the inner container;

wherein the inner container has a parallelepipedal shape or a cubic shape with four sidewalls, a bottom, and a top wall;

wherein the inner container has a closable filling socket provided on the top wall and an outlet socket provided near the bottom on one of the sidewalls, wherein the outlet socket has an outer thread for receiving a tap fixture and has an electrically conducting outer layer;

an outer jacket surrounding the inner container and comprised of metal bars or sheet metal;

wherein the outlet socket is formed as a unitary part of the inner container by blow-molding and has an outer cylindrical end drawn inwardly in a direction toward the interior of the inner container and forming an inner ring with an annular electrically conducting inner layer that is in contact with a liquid filled into the inner container for electrically grounding an interior of the inner container;

wherein the electrically conducting inner and outer layers of the outlet socket and the external container layer of the inner container form a homogenous electrically conducting layer providing inner and outer electric grounding of the inner plastic container.

2. The container according to claim 1, wherein the inner container is comprised of three layers.

3. The container according to claim 2, wherein the three layers comprise an inner container layer and an external container layer, wherein the inner and external container layers are comprised of high-density polyethylene, wherein the starting material for the inner and external container layers is new granular high-density polyethylene material, and wherein the external container layer contains conducting carbon black.

4. The container according to claim 3, wherein the three layers comprise a central container layer arranged between the inner and external container layers, wherein the central container layer is comprised of high-density polyethylene, wherein the starting material for the central container layer is recycled granular polyethylene material or recycled ground polyethylene material.

5. The container according to claim 4, wherein the starting material of the central container layer is pure polyethylene; polyethylene comprising a conducting carbon black fraction; or a mixture of pure polyethylene and polyethylene comprising a conducting carbon black fraction.

* * * * *